United States Patent [19]

Browne et al.

[11] Patent Number: 4,744,163

[45] Date of Patent: May 17, 1988

[54] SEVEN BAR MODULE

[75] Inventors: John Browne, Georgetown; Thomas Wales, Rexdale, both of Canada

[73] Assignee: Nei Canada Limited, Toronto, Canada

[21] Appl. No.: 857,498

[22] Filed: Apr. 30, 1986

[51] Int. Cl.[4] ..... G09F 9/00

[52] U.S. Cl. ..... 40/449; 40/446; 40/450; 340/815.05; 340/815.24; 340/815.26

[58] Field of Search ..... 40/449, 450, 446, 447; 340/764, 815.04, 815.05, 815.24, 815.26

[56] References Cited

U.S. PATENT DOCUMENTS

| | | | |
|---|---|---|---|
| 3,096,594 | 7/1963 | Skrobisch | 40/449 |
| 3,363,347 | 1/1968 | Benson | 40/449 |
| 3,537,197 | 11/1970 | Smith | 40/449 |
| 3,914,723 | 10/1975 | Goodbar | 335/79 |
| 3,924,528 | 12/1975 | Ludin | 101/93.15 |
| 4,117,478 | 9/1978 | Skrobisch | 340/815.04 |
| 4,161,832 | 7/1979 | Bergamini | 40/449 |
| 4,223,464 | 9/1980 | Winrow | 40/449 |
| 4,233,382 | 11/1980 | Edwards et al. | 430/39 |
| 4,308,528 | 12/1981 | Hummel et al. | 40/449 |
| 4,459,587 | 7/1984 | Leuthesser | 340/764 |
| 4,566,210 | 1/1986 | Winrow et al. | 40/449 |
| 4,577,427 | 3/1986 | Brown | 40/449 |

FOREIGN PATENT DOCUMENTS

| | | | |
|---|---|---|---|
| 3500459 | 8/1985 | Fed. Rep. of Germany | 340/764 |
| 1471094 | 4/1977 | United Kingdom | 40/449 |
| 2161307 | 1/1986 | United Kingdom | 40/449 |

*Primary Examiner*—Carl D. Friedman
*Assistant Examiner*—Michael Safavi

[57] ABSTRACT

Electromagnetically actuated rotatable display element uses low coercivity magnetic core drive through cores running parallel to the rotation axes and magnets on the element outside each end of the cores.

3 Claims, 3 Drawing Sheets

Figure 1:
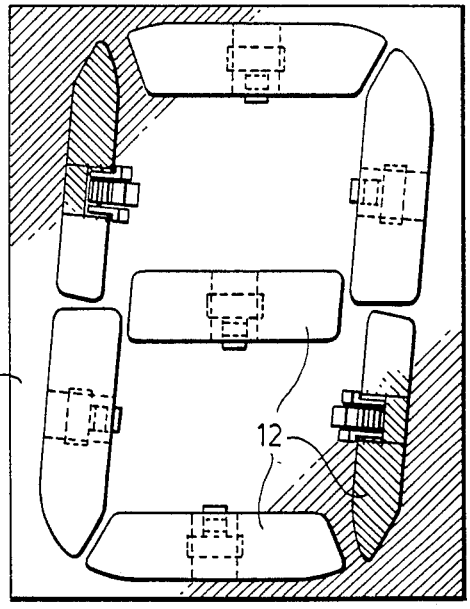

FIG. 5
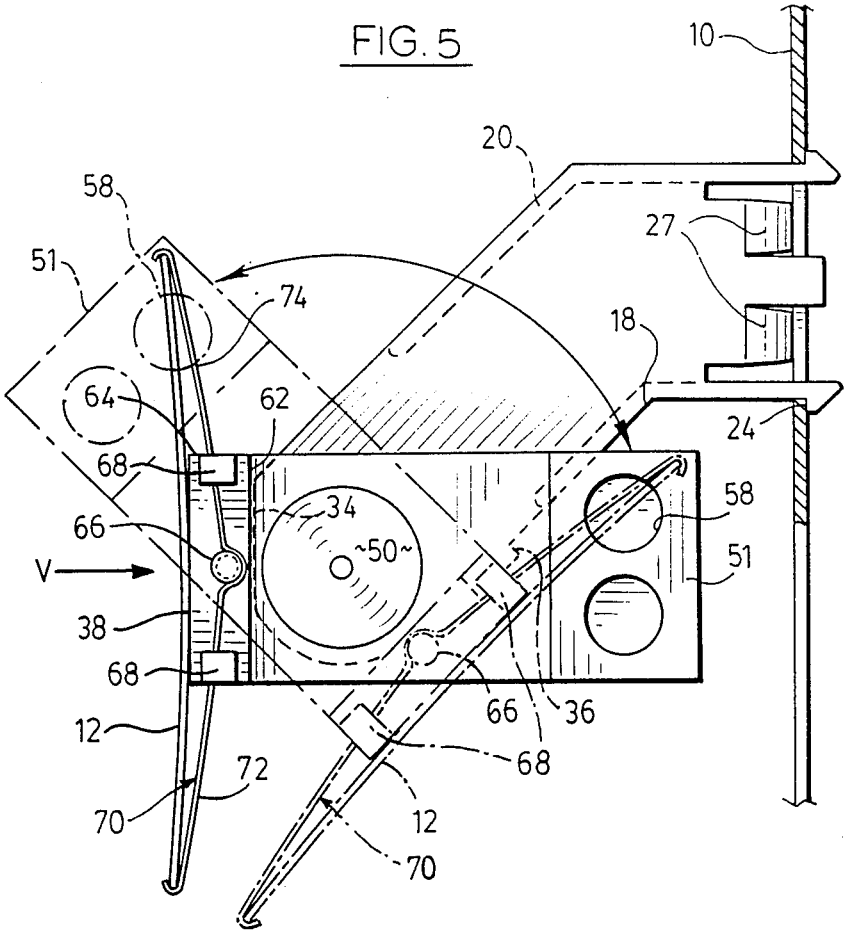
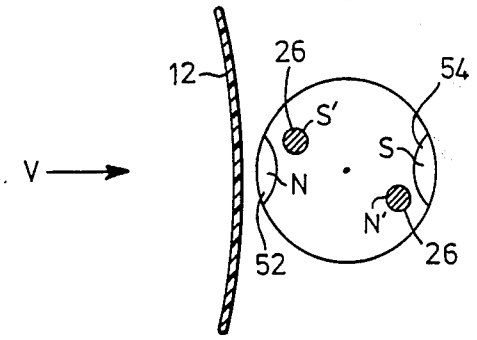
FIG. 6
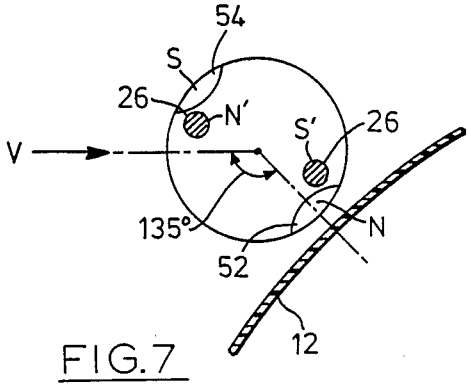
FIG. 7

SEVEN BAR MODULE

This invention relates to a display or indicating element suitable for use alone or in combination with other such elements to selectively make letters or figures.

The invention in its commonest usage, will be used for the same purposes as prior U.S. Pat. No. 4,223,464 dated Sept. 23, 1980 and assigned to Ferranti-Packard Limited. However the inventions described herein are not limited to uses described in the patent above.

The display element in U.S. Pat. No. 4,223,464 has a pair of permanent magnets rotating at opposed ends of a pair of magnetic cores. The cores as described in the Patent are of high coercivity material. These high coercivity cores have the advantage that their polarity may be switched or 'set', by a pulse of short duration shorter than and of duration independent of the time for the display element to move from one limiting position to the other. The display elements if accidentally displaced from their 'set' position will tend to return to it. However they have the disadvantage that the high coercivity requires a relatively high increase in switching power i.e. energizing coil current to produce a relatively low increase in switching torque. In some applications 'sticking' of the display element occurs in its set position, and the high switching power required by high remanence cores renders it difficult and expensive to raise the power sufficiently to overcome a sticking problem.

It is therefore an object of this invention to provide a display or indicating element having the general physical configuration of that shown in U.S. Pat. No. 4,223,464 but using soft iron or low coercivity cores. The result is a switchable display element wherein the increase in driving torque to switch the element from one position to the other is closely related to the increase in switching power applied. A tendency to stick in a particular application can thus be relatively easily avoided by increase of the coil energizing current. The duration of the switching pulse is increased and the element does not necessarily return to its 'set' position after accidental deflection, but rather magnetically latches in whichever of the limiting position it comes to rest. However in many applications the ability to conveniently increase switching power to avoid sticking outweighs the disadvantages.

"The viewing direction" referred to herein is the approximate centre of the solid angle defined by the limits of directions in which it is intended that the display sign will be viewed.

"Outward" herein refers to the direction from the sign toward the viewing direction and "inward" is in the opposite direction. (It will be appreciated that the rotor has a display and an obscured position and "inward" and "outward" on the rotor have reference to its attitude in the display position.

By "display position" we mean that rotor limiting position where the "display surface" (that is the contrasting surface) of the rotor is displayed in the viewing direction and the "obscured position" of the rotor is the limiting position where the contrasting surface is obscured in the viewing direction.

By "flag" we mean a member having display surface which member is separable from the rotor and attachable thereto.

The application uses two permanent magnets usually circular and coaxial with the rotation axis rotating o the rotor opposite the free ends of the magnetic cores which permanent magnets are locally magnetizable to form diametrically opposed North and South poles facing respective cores. Each of such poles has a complementary pole at the side of the permanent magnet remote from the cores. It is found that the strength of such magnets are increased if a soft iron bridge is provided on the side of the magnet remote from the cores to complete the magnetic circuit between the complementary locally magnetized poles.

It is therefore an object of the invention to provide a permanent rotor magnet magnetized axially on diametrically opposed sides with a bridging soft iron member, as described in the previous paragraph.

In preferred designs of the invention the display surface of the rotor is a surface or 'flag' longitudinally extending on each side of the remainder of the rotor in a direction parallel to the rotor axis. In the display limiting position the display surface or flag is displayed in the viewing direction and the flag is colored to contrast with its background. In the other or obscured limiting position the display surface flag is rotated so that the contrastingly colored surface is obscured in the viewing direction. The greater the angle of rotation beyond 90° the wider the angle through which the sign may be viewed without seeing the contrasting surface on the obscured position. The closer the angle of rotation approaches 180°, the more serious the reduction in starting torque. The compromise between these requirements is to choose an angle of about 135° and in any event between 125°–150°. To attach the support for the stator and rotor to a support plate it is easier to design a support which projects from the support plate in a direction parallel to the viewing direction. In order, then, to obtain 135° rotation it is easier to slope the outer extent of the support which is preferably a pillar in the direction of rotation of the display element from the display position toward the obscured position. This slope, which preferably is at an angle equal the difference between the desired rotation and 90° provides a convenient 'underhang' to receive the display surface or 'flag' in obscured position. Where the desired rotation is 135° the angle of the slope of the outer extent to the inner extent of the pillar is therefore 45°.

It is an object of this facet of the invention, therefore to provide, in combination with a support plate facing in the viewing direction, a rotor support in the form of a pillar with an inner extent extending from the support plate and perpendicular thereto, and an outer extent sloping at an angle to the inner extent in a direction corresponding to the direction of rotation of the display surface or flag from the display to the obscured position.

It is an object of another facet of the invention to provide a rotor having three projections at each side projecting from the body of the rotor in the axial direction, the three projections being generally disposed transverse to the viewing direction when the rotor is on its first (display) limiting position. A resilient spring wire member is designed to attach to each three projections on flexing to rest inward of the central projection and outward of the two outer projections with two outer ends or arms projecting in a shallow V facing the viewing direction in the first limiting position. The spring wire, for attachment to the projections has been flexed to decrease the angle of the V. The arms end in hooks formed by reverse turns to free ends outward of the arms. The flag in this arrangement is a longitudinally extending resilient member of convexo-concave shape with its display surface on the concave side extending transverse to the viewing direction. The resilient flag is designed so that it must be flexed to increase the concavity to allow its edges to be inserted and held in the two pairs of arm hook ends. It is an object of this facet of the invention to provide a flag attached in this way and it will be appreciated that the flags attached in this way are readily replaced in case of damage or loss.

Other objects and advantages will be apparent from the description of the preferred embodiment to follow.

Figure 2:
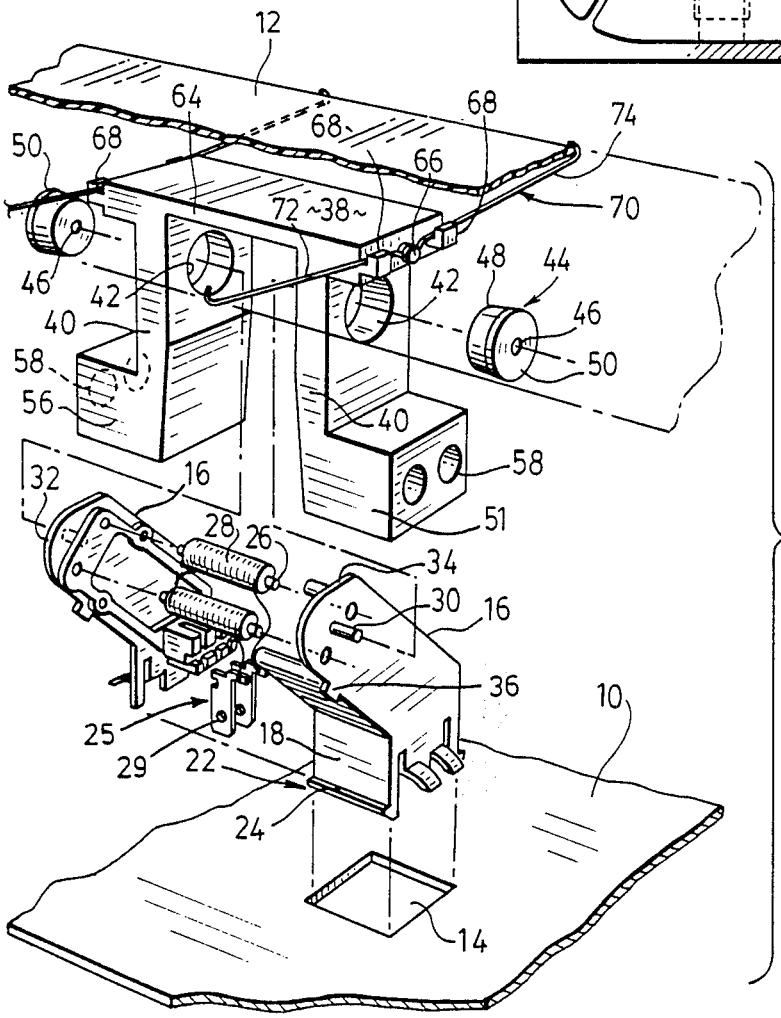
Figure 3:
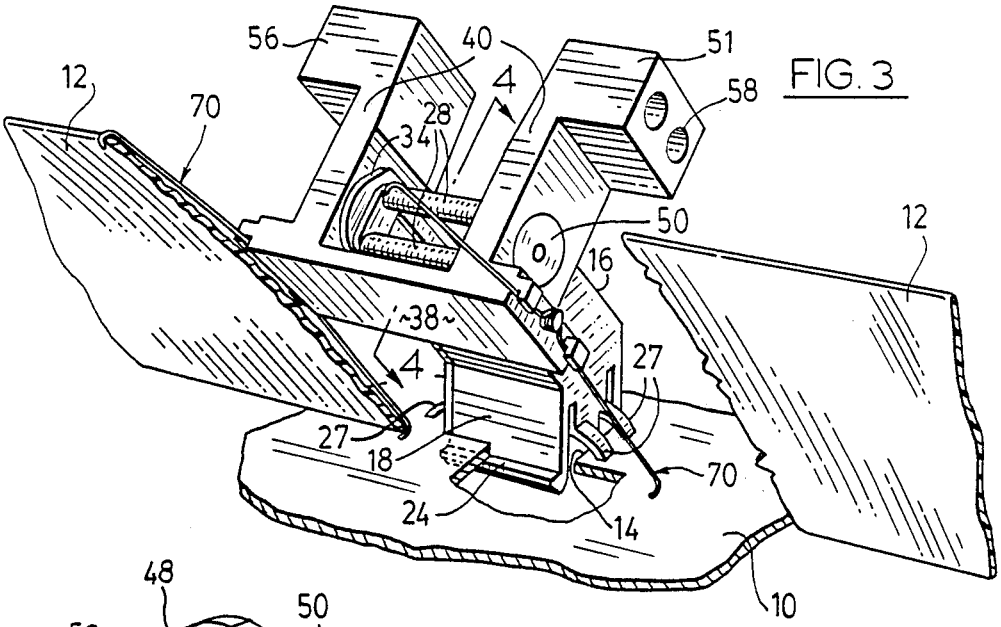
Figure 4A:
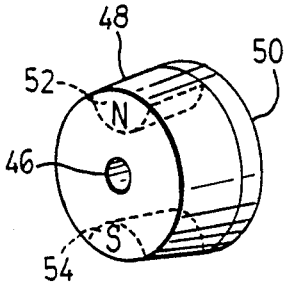
Figure 4:
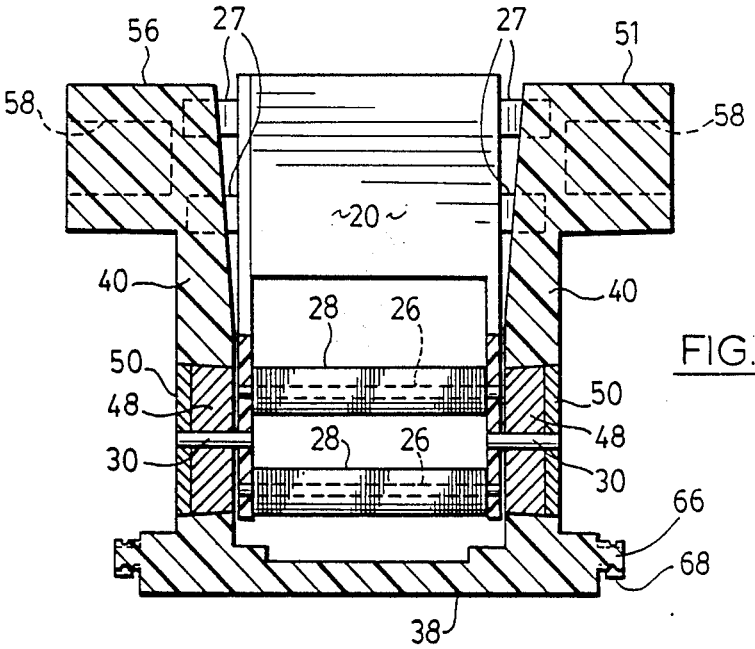

In drawings which illustrate a preferred embodiment of the invention:

FIG. 1 is an illustration viewed from the viewing direction of seven display elements in accord with the invention, FIG. 2 is an exploded perspective view showing the construction of the rotor, stator and support plate, FIG. 3 is a perspective view of the rotor and stator in the second or obscured limiting position, FIG. 4 is a section showing the rotor and stator along a plane through the rotor axis and parallel to the viewing direction, FIG. 4*a* is a view of a magnet assembly, FIG. 5 is a partially schematic view showing the movement of the rotor between display and obscured position, FIGS. 6 & 7 schematically indicate the operation of the device.

In the drawings FIG. 1 shows a support board 10 facing in the viewing direction in (FIG. 5) and mounting seven display elements arranged to provide by selective switching of the display elements the digits 0 to 9. In FIG. 1 the upper left and lower right display elements are in obscured position, showing the backs of the display surfaces or flags 12 which backs correspond in coloring to the background, while the remaining elements are in display position with the display surfaces of the flags contrasting with the background so that the number '2' is shown.

FIG. 2 shows the support board 10 with a square aperture 14 in which the stator pillar may be clipped. The stator pillar comprises opposed side plates 16 having an inner straight extent perpendicular to the support board and an outer straight extent sloping at 45° to the inner extent in what will turn out to be the direction of rotation of the rotors from display toward obscured position. Inner and outer end walls 18 and 20 join the edges of opposed side walls to form a square in transverse section through the pillar. The end walls 18 and 20 stop a short distance outward of the beginning of the slope in the pillar. The pillar is attached to the board by resiliently inwardly deflectable dogs 22 inwardly projecting from end walls 18 and 20 and having outwardly facing shoulders 24 which, after such inward deflection insertion and release engage the inner surface of the board 10 to retain the pillar in position. The side walls are provided with inwardly diverging supports 27 which abuttingly meet the outer surface of the board 10 to help maintain the pillar rigid. It will readily be appreciated that, if desired, the dogs 22 may be positioned on the side walls and the supports 24 on the end walls. The side walls and end walls may be attached by adhesive or by other means as desired.

Toward the outer end of the pillar a pair of low coercivity or soft iron cores 26 extend longitudinally and parallel between the side walls 16. Energizing coils 28, surround the cores and are supplied with current from a source, not shown. Halfway between the cores 26 side walls 16 mount aligned outwardly projecting stub shafts 30 on which the rotor is to be mounted. Alternatively the two stub shafts are replaced by a single central shaft extending between the side walls and projecting herefrom. The outer edges of the side walls are provided with a rounded arc 32 over which the rotor may rotate and are shaped to provide, at each end a shoulder (34 and 36 respectively) which limits the movement of the rotor at display and obscured position respectively.

The rotor preferably comprises a rectilinear outer wall or crossbar 38 with a pair of opposed legs 40 extending inwarding therefrom at a spacing such that such legs may extend (and rotate) on each side of the pillar adjacent opposed side walls 16. Opposed circular apertures 42 are provided in the legs 40 of a size to receive generally cylindrical permanent magnets assemblies 48. The magnet assemblies are preferably slightly tapered to allow easy insertion in the apertures 42. In place, the magnet assemblies are held in place by adhesive or any other desired means. The magnetic assemblies are centrally apertured at 46 to rotatably to receive the stub shafts. The central apertures are preferably lined with low friction bearing material of the rotor on the stator stub shafts 30.

The magnet assembly comprises a cylindrical high remanence high coercivity thicker portion 48, preferably nearer the free ends of cores 26 and a cylindrical low coercivity or soft iron thinner portion 50 farther from the free ends of cores. The high coercivity portion of each magnet assembly is locally magnetized at 52 and 54 parallel to the rotary axis to provide respectively diametrically opposed N and S poles nearer the coil free ends as best shown in FIG. 4*a*. Since the magnetization is in the axial direction the N pole shown requires a complement south pole (not lettered) at the low coercivity layer 50; and the S pole shown requires a complement north pole (not lettered) at the low remanence layer. The low remanence layer 50 thus provides a short closing the magnetic circuit between the complement poles. It is found that this arrangement greatly improves the flux density at the core-adjacent poles N and S, and the operation of the display element is thereby improved. The size of the magnet assembly is chosen so that the locally magnetized poles N and S are at each side of the pillar directly opposite the free ends of core 26. The inward ends of legs 40 are provided with axially projection abutments 56 and these are provided with axially open bores 58. These bores will be sized, larger and smaller to balance the rotor including the flag about its pivot axis.

Surface of rotor cross bar 38 are designed to act, in cooperation with the stop surfaces 34 and 36, to define the display and obscured limiting position respectively. Thus the inward surface 62 of the cross bar contacts surface 34 at the display limiting position and the edge 64 of the cross bar contacts the surface 36 at the obscured limiting position.

The axially directed edges of cross bar 38 each form three axially directed projections formed in a line transverse to the viewing direction. Central projection 66 is notched on its inward surface and outer projections 68 are notched on their upper surface to allow nesting of the resilient wire 70 which, as shown is shaped in notches outward of the outer projections 68 and inward of the central projection 66. The wire is provided with arms 72 and 74 extending transversely on each side of the rotor in a shallow, outwardly directed V. The unstressed attitude of the wire is such that it must be flexed to slightly narrow the V to fit into the projection notches. Thus the wires are stressed when supported in the notches and will 'stand' on the rotor so stressed, for insertion of the flag. The outer ends of the V arms are reversed turned in the outward direction through about 135° to receive the edges of the flag 12.

The flags shaped as any one of those shown in FIG. 1 are preferably parallel sided and designed to extend longitudinally on each side of the rotor. The flag is constructed of resilient plastic or metal and alone at rest designed to assume a concavo-convex shape slightly wider from edge to edge than the hooked ends of the V arms. The concave surface of the flag is the 'display surface' and is colored (here with a light color) to contrast with the background of the board 10 and is displayed in the viewing direction on the display position of the rotor. (The solid line position of FIG. 2). The convex surface of the flag is colored to correspond to the background, (and to those parts of the rotor and stator exposed in the obscured position in FIG. 5). The flag 12 is attached to the wires as they 'stand' on the rotor by flexing the flag 12 to increase its concavity and placing its opposed longitudinal edges in the exposed wire hooks. The flag then unbends resiliently along its length and bears on the inside of the wire hooks and is securely retained in position. It will be noted that the extra stress provided on the wire hooks by the flag increases the flexure pressure of the wire hooks on the projections, making the connection between the wire and the hooks more secure.

In other applications than the 7 bar module of FIG. 1 the flag may have any other shape with edges suitable for coupling to the wires 70.

Two terminals 25 attach to the molding side walls and connect to the respective coils which are connected in series. The coil winding and connection are arranged so that the outer ends of cores 28 are of opposite polarity and switchable by the pulses of coil current. Inward ends 29 of terminals 23 are connected to a source (not shown) of the current pulses.

The operation is described through the schematics of FIG. 6 and 7 with reference also to FIG. 5. FIGS. 6 and 7 show the magnetism of the core 26 ends at the end viewed in FIG. 5. FIG. 6 shows the rear ends of cores 26 magnetized to polarities S' and N' to attract the poles 52 and 54 of magnet 44 to the display position of the rotor as shown in the solid line position of FIG. 5. The opposite ends of the cores 26 are each oppositely magnetized but the corresponding magnet 44 is oriented to produce identical magnetic torque to that shown. When it is desired to rotate the rotor to the dotted line position of FIG. 5, the coils are pulsed to reverse the polarity of the cores 26 so that, with reference to FIG. 7, the new N' and S' magnetized core ends attract the S and N poles 54 and 52 to swing the rotor 135° to the dotted line position of FIG. 5. In connection with the magnetic drive, it will noted that the magnetic axis of the core ends 26 is offset from the magnetic axis of the permanent magnet 44 by $(180-135/2)=22\frac{1}{2}°$ at each end, giving a good starting torque when the polarity of the cores is reversed. The remote end of the rotor and cores will of course provide the same torque and in the same sense. When the cores 26 are switched, because they are of soft iron, the switching pulse in windings or energizing coils 28 must be maintained until the permanent magnet poles have latched to the respectively adjacent cores in the new position.

We claim:

1. Display or indicating device defining a viewing direction including:

a support, a display or indicating element on said support rotatably mounted on said support to rotate on an axis of rotation relative thereto, and surrounded by a background when viewed in the viewing direction, a display surface on said element designed to contrast with the background when displayed in the viewing direction, means limiting rotation of said display element to rotation through a predetermined angle between a first limiting position where said display surface is displayed in the viewing direction and a second limiting position where said display surface is not visible in the viewing direction, a pair of substantially parallel longitudinally extending cores of magnetic material, extending generally parallel to said rotation axis and between first and second free ends, an electrical energizing coil corresponding to each core for magnetizing the latter, first and second permanent magnets mounted on and rotatable with said display element, the pair of first free ends and the pair of second free ends each being designed, when each pair is of mutually opposite magnetic polarity, to define a magnetic flux path of reversible polarity between each pair of free ends, each of said flux paths including a locus of one of said magnets over said rotational range and being arranged so that, for a given polarity each flux path exerts, a torque in one sense over the range of movement, between two limiting positions, of the corresponding permanent magnet, and so that said torque is in the same sense for both magnets, each said permanent magnet comprising a layer of permanently magnetized high remanence material adjacent the core ends and a layer of soft iron or low remanence material remote from the core ends.

2. Display or indicating device as claimed in claim 1 wherein said high remanence material is magnetized to provide on the side nearest the core ends a North pole at one radially outer location and a South pole diametrically opposed thereto.

3. Display or indicating element as claimed in claim 1 wherein said support is mounted on a base plate and has an inner extent projecting from the base plate in a direction opposite the viewing direction and an outer extent at an angle of at least 35° to said inner extent, extending in a direction of movement of said display surface with said direction of movement extending from said first to said second limiting position.

* * * * *